United States Patent [19]

Messinger

[11] Patent Number: 5,035,456

[45] Date of Patent: Jul. 30, 1991

[54] VACUUM CONTROL SYSTEM FOR LIFTING SYSTEMS

[76] Inventor: Robert Messinger, 353 Circle Dr., Palmerton, Pa. 18071

[21] Appl. No.: 500,969

[22] Filed: Mar. 29, 1990

[51] Int. Cl.[5] ..... B66C 1/02

[52] U.S. Cl. ..... 294/64.1; 901/40

[58] Field of Search ..... 294/64.1, 65, 2; 901/40; 414/737, 752; 269/21

[56] References Cited

U.S. PATENT DOCUMENTS

| | | | |
|---|---|---|---|
| 3,558,171 | 1/1971 | Netsch et al. | 294/64.1 |
| 3,677,598 | 7/1972 | Becker | 294/64.1 |
| 3,743,340 | 7/1973 | Williamann | 294/64.1 |
| 4,266,905 | 5/1981 | Birk et al. | 901/40 X |
| 4,413,853 | 11/1983 | Andersson | 294/64.1 |

*Primary Examiner*—Margaret A. Focarino
*Assistant Examiner*—Dean J. Kramer
*Attorney, Agent, or Firm*—John S. Roberts, Jr.; Laurence R. Brown

[57] ABSTRACT

This invention provides improved body length adjustment value structure for a vacuum powered lifting system of the type that embodies a variable length lifting body responsive to the differential of pressure inside that body with atmospheric pressure to resolve critical manual control problems. Thus control is provided by proportional movement of a control member over a substantially linear range producing a smooth progressive movement of the lifting mechanism. This permits non-critical lowering and release of a work load object by unskilled operators. Thus, an air injection valve with an air release port, is positioned within the lifting body having an elongated slot operable over a control range proportionately change the body length by release of a progressively increasing flow of air into the body to increase air pressure and body length over the critical range of lowering and releasing the work load object in response to a corresponding substantially linear movement of the control member. Variable adjustment value structure establishes a known upper lift limit by control of the length of the body both under loaded and unloaded conditions, and provisions are made to keep a vacuum responsive work object grasping mechanism continuously operable.

8 Claims, 1 Drawing Sheet

VACUUM CONTROL SYSTEM FOR LIFTING SYSTEMS

TECHNICAL FIELD

This invention relates to vacuum powered lifting and transport systems and more particularly it relates to pressure control within a vacuum powered lifting mechanism that changes in length with differences in air pressure.

BACKGROUND ART

Vacuum powered lifting and transport systems are known in the prior art. One example is shown in U.S. Pat. No. 4,413,853, S. Andersson, Nov. 8, 1983, wherein a tubing that changes length with internal air pressure is shortened by means of a vacuum source to lift a work object by vacuum suction and transport it to another location.

While these vacuum powered type of lifting and transport systems have advantages in engaging, lifting and transporting work load objects weighing 200 pounds or more along assembly lines in a factory, for example, several problems and deficiencies are present in such prior art systems that have limited their usefulness. Some limitations have made such systems potentially dangerous, in that heavy work load objects are critical to control and may be inadvertently dropped from the lifting mechanism or inaccurately positioned with uncontrollable speed.

It has been found in accordance with this invention for example that air pressure control systems employed in vacuum powered lifts to engage, lift, transport and release heavy work load objects have critical ranges of load positioning and work object grasping and releasing procedures requiring significant concentration and skill by an operator. In particular, operators must become very skilled in controlling air pressure changes particularly when lowering heavy work load objects to a terminal location under transition conditions from near atmospheric pressure to minimum pressures supplied by a vacuum source, to prevent premature release or mispositioning of the work object, which can impact with accompanying danger of damage to equipment or operator.

Criticality in atmospheric controls in such systems also are encountered as well as other deficiencies, such as (1) variations in performance and positioning of the lifting mechanism when loaded and unloaded; (2) the possibility of work object grasping failures; and (3) malfunctioning or mispositioning due to critical manual operational conditions in pressure control mechanisms.

It is therefore an object of the invention to provide improved vacuum powered lift and transport systems and controls overcoming the foregoing problems encountered in the prior art.

Other objects, features and advantages of the invention will be found throughout the following description, drawings and claims.

DISCLOSURE OF THE INVENTION

A safer vacuum powered lift and transport system that extends the functional performance and eliminates tedious and critical operator dependent controls is provided in accordance with this invention by means of a combination of novel control features interacting with the vacuum system. Thus, new functional advantages are obtained by height adjustment means establishing a predetermined operator-independent variable maximum height of the lifting mechanism for both unloaded and loaded conditions, and providing uncritical manually operable pressure control mechanisms for proportionately changing the vertical position of a work load object over a smooth uncritical progressive and substantially linear movement range of a control member.

Potential operational dangers and malfunctions are eliminated by features assuring that work load objects are firmly grasped over a wider range of operating conditions, and that the work load objects are assured of controlled manual release of a work object from grasp without the danger of damage or mispositioning. Thus, a manually operable length control mechanism provides internal pressure control within a lifting mechanism that vertically retracts and thus lifts by means of a vacuum source. This provides a control member movable over a substantially linear range of manual movement producing proportional changes in length of the lifting mechanism. This is achieved by means of a valve mechanism for injecting a flow of air into the mechanism body to increase pressure and thus extend the body length proportionately with movement of a manually controlled member that opens up a corresponding portion of the length of an injecting slot outlet port through which the air flow path is directed.

The nominal closed position of this proportionate control valve mechanism is variably adjustable to feed a predetermined flow of air that establishes a predetermined safe upper limit of vertical lift movement in response to a vacuum pumping source. The internal air pressure of the lifting mechanism is further controlled adjustably to a predetermined pressure in the absence of a work load object in the grasp to establish an optimal no-load height. Critical control of the elongated condition near maximum air flow into the lifter body during lowering and release or in readiness for grasping a new work load object is eliminated by linearizing air flow control means so that the operator need not be well trained and need not encounter critical conditions. An air vented lifting body grasping surface eliminates the possibilities of failing to grasp a work object in position for lifting and transport.

These features are shown in the accompanying drawings, in which similar reference characters are used in the various views to indicate similar features.

THE PREFERRED EMBODIMENT

Figure 2:
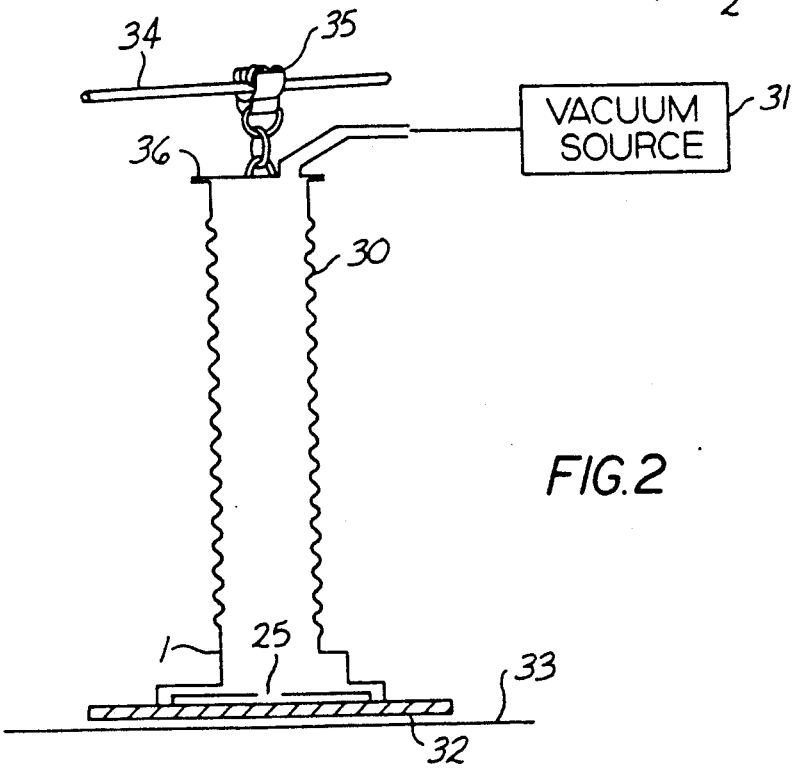
FIG. 2 is a schematic system diagram for illustrating the interacting control features of the invention.

Now with reference to the drawings, it is seen from FIG. 2 that the primary control mechanism 1 for the system may be located in the lower lifting mechanism body portion generally comprising the lowermost cylindrical cap to the expandable and retractable body portion 30. Its collapsed length is controlled by restricting the air flow into the vacuum source 31 and internal air pressure modifying means for lengthening the body 30.

Figure 1:
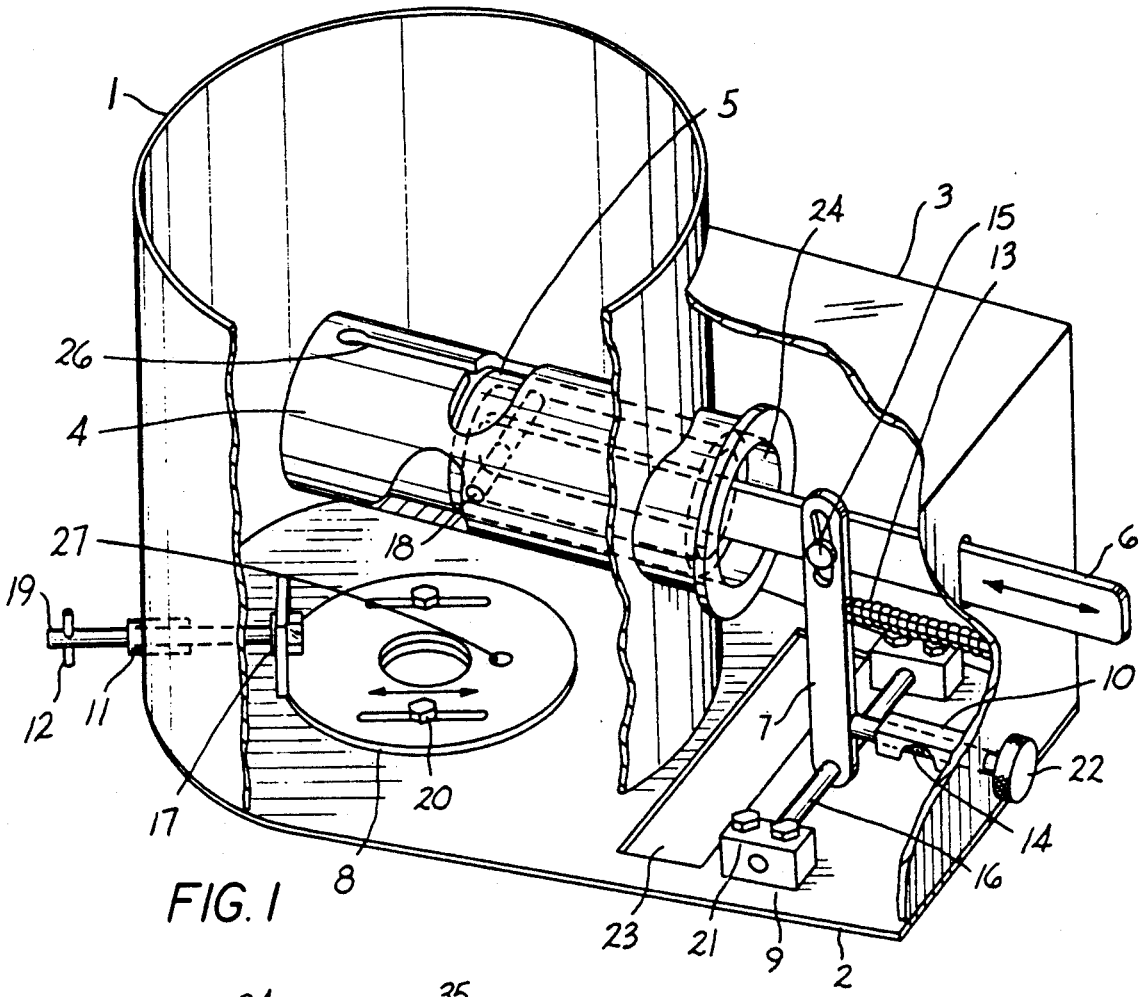
FIG. 1 is a perspective view, partly broken away view of an air flow control system embodiment of the invention affording improved lifting mechanism performance.

The specific control mechanisms of FIG. 1 thus control grasping, balancing, lifting, transporting, lowering and releasing the work load object 32 from or onto a work surface 33, which might be a movable conveyor or a factory floor. The transport line 34 typically provides for transport of the lifted work object 32 to another location by means of riding carriage 35, coupled to an uppermost cap 36 on the lifting mechanism body 30. In operation therefore the differential in pressure inside the lifting mechanism body 30 and the atmosphere as provided by the balancing of the vacuum source 31 with injected atmospheric air will proportion the retraction or foreshortening of the vertically disposed longitudinal lift mechanism body 30 to lift the work body objects 32 upwardly off the surface 33 for transport. Conversely the pressure within the lift body 30 can be returned to substantially atmospheric to lengthen the body and lower the work body objects toward the surface 33. Both this general type of vacuum powered lifting system operation and accompanying lifting element, vacuum power and transport construction is known in the art and thus need not herein be discussed in greater detail.

Now the construction and operation of the improved body length control system of FIG. 1 for introducing variable quantities of atmospheric air flow into the lift body to modify the lower pressure established by the vacuum source as provided by this invention is discussed.

Atmospheric air enters the control enclosure 3 through an access port 23 and passes into the control valve body 4 where it exits through a critically shaped slotted opening exit port 24. The air exits from the valve body 4 in the interior of the lift body portion 1 at a generally centrally located position along the body longitudinal axis for optimum effect and to avoid delayed transit time for effectuating control. The longitudinally positioned valve slot 26 is cut into the side wall of the valve body 4. A longitudinally movable diaphragm or control valve member 5 opens more or less of the length of slotted exit port 26 to release air by the axial positioning of the member 5 by way of control rod member 6 to move within the valve body 4 cylinder, or equivalent valve housing.

Control rod 6 is thus reciprocated as represented by the two headed arrow, typically by a human operator supplied with a suitable control handle (not shown). This is a critical operation for controlling the length of the lift mechanism and the grasping, movement and releasing of the work object. In particular control is most critical in the lengthening of the tube to lower and release a work product or to grasp it by increasing the flow of air into the lift body.

Balancing of the vacuum source contribution and increased pressure due to input atmospheric air is necessary to lower the lifting mechanism for grasping the work body object when unloaded. Also critical is the lowering of a work load object, which must be precisely controlled by increased input air flow to balance the vacuum source contribution for lowering the work load object to deposit it on the work surface. Disproportionate and critical operator control means for this in prior art systems introduced operator concern and tediousness, required critically trained and experienced operators and produced risks of dropping a work load object with potential danger to personnel or equipment or in an improper location. This invention provides the precision proportional control by the operating lever of the length of the lifting mechanism over a substantially linear direction, which is afforded by the shape of the slot serving as air exit port 26 in the preferred embodiment.

The exit port shape is controlled for the dimensions of the lift body and the vacuum source characteristics in a manner easily determined by those skilled in the art to achieve a substantially linear and proportional control with movement of the control lever 6 in a manner that is uncritical to require little skill and experience from an operator. Other shapes and configurations of this valve structure will become evident from the teachings of this invention.

It should be evident therefore that this invention provides the operator with means for smooth, progressive and substantially linear control of the length of the lifting mechanism and therefore enables precision placement, grasping, lifting, transport and release of work products in a manner not heretofore feasible with prior art system controls.

Further features of the invention which relate to the interaction of the pressure control means of this invention with the reaction of the lifting mechanism to produce improved control features and modes not available in the art, include variably adjustable height control means for producing an operator-independent uppermost lifting limit under both the conditions of no-load and full load.

These control means operate to vent variably adjustable minimal magnitudes of flow of air into the lift mechanism body by means of two adjustable venting valves.

Thus the sliding valve plate 8 is provided to effect a first control function of establishing the predetermined height which the control unit of FIG. 2 will take in the absence of a load. The load supplied by a work load object to be lifted is disposed below the bottom plate 2 and serves to seal the vent 25 when the lift control valve member 4 establishes a reduced pressure by occluding the air vent slot 26. The decreased pressure within the lift mechanism body in essence sucks the surface of the work load object into surface contact.

In accordance with this invention the vent valve opening 25 is adjusted to vent in the absence of a work load a predetermined amount of air that will cause the lift mechanism to shorten and raise the control unit 1 to a predetermined height in a normally inactive condition with the vacuum source attached. Thus the knob 12 of adjustment screw 19 moves adjustment valve plate 8 over a part of the vent opening 25 as permitted by the bolt-slot assembly 20, with the adjustment screw threaded through the housing at 11 to move the valve flange member 17 reciprocally. The size of the venting aperture 25 is thus controlled so that the unloaded control unit 1 will lift to an established pre-set position and hang there when the lifting valve 5 is in its normally closed inactive position and a work load object is not grasped to seal the vent valve opening 25. Further this structure provides a continuous flow of air in the absence of the work load so that the vent is not sealed. This provides assurance of an immediate grasp of the work load without complicated manipulation of pressure controls or repositioning of the bottom plate 2 as the pressure within the lifting housing is decreased from its highest pressure limit at which the housing is extended at its longest length. The opening size control means also serves through the access port to assure a maximum vacuum sealing grasp for a work object located below the bottom plate 2.

When little or no air passes through the venting aperture 25 in the bottom plate 2, because a work object is grasped to seal the opening, another mechanism becomes necessary to determine the vertical position attained when the control valve 5 cuts off air flow into the lifting mechanism body and the lowest vacuum pressure level is attained, thereby producing the most retracted lift body length and the highest position that the work load object can attain. Thus the screw assembly 22 is provided for adjusting a stop position for the control valve operating rod 6 in the normally inactive position attained by means of the bias spring 13 in the absence of active manual or equivalent control movement of the control rod 6. The screw is threaded through the enclosure body 3 to move the pivot arm 7 about the axis of pivot rod 16 mounted in bearing blocks 9 by means of bolts 21. Pivot arm 7 is slotted at 15 for movement of the pivot pin in control rod 6 over the arc of movement of the pivot arm 7 and accompanying linear axial movement of control rod 6.

The screw assembly 22 thus establishes a minimal opening size of the slotted vent port 26 in control valve 5 for feeding atmospheric air into the lift mechanism body to prevent a low enough pressure established by the vacuum source to retract the length of the lift mechanism beyond a point establishing a maximum height of the work piece object under load when port 25 is closed. The return spring 13 is slightly weaker than the bias spring 14 interposed in the adjustment link. Thus, the return spring 13 does not cause the slot 26 to be fully opened when the operator releases control rod 6 to let it return to its normal position, with the vacuum source connected. Thus, the length of the lift mechanism is adjusted in that condition by the screw assembly 22 to determine the maximum height and to assure a minimum pressure limit inside the lift mechanism body from the vacuum source. It is assured then that a loaded lift will attain a predetermined operator-independent height, as well as an unloaded lift, respectively by means of adjustment screws 22 and 19.

In operation therefore the control mechanism of this invention as shown in detail in FIG. 2 operates the vacuum powered lifting system in different modes of operation than prior art systems to overcome the deficiencies in the prior art heretofore set forth. The proportional movement of the lift mechanism with the position of the control rod 6 thus gives noncritical control of a load, particularly in the lowering release operation, which has been critical and hard to adjust in prior art vacuum lift systems. Accordingly, as more and more air is injected by the control valve slot 26 at a critical position along the vertical axis of the lifting mechanism the lift body lengthens to lower a work load object over a distance proportional to the movement of the control rod 6. The operator thus has to have no particular expertise and need not be concerned with critical concentration to operate a valve through a critical and sensitive non-linear region where very small movements of a control lever cause very large changes in interior lift housing pressure as provided in prior art systems.

Furthermore the operator need not be concerned with the operation to attain a preferred height for the work load, or for the bottom plate 2 of an unloaded lift mechanism by manipulation of the control rod 6, since these uppermost position limits are pre-set by means of adjustment screws 19 and 22. The control range within proper position limits and operational limits of the vacuum system is assured so that the possibility of operator error that could damage equipment or inadvertently drop a work load object is eliminated.

Also because of the grasping structure about vent 25 in plate 2, adjusted to provide a continuous flow of air to establish a proper grasping pressure at the bottom plate when a work object is not being grasped, assures that there is no condition where a load would not be grasped when the control rod lever 6 is used to close the air control valve slot 26 and permit pressure to decrease within the lift mechanism body for vacuum grasping and lifting the work object. The prior art attempts to prevent any leakage through the grasping structure by valving structure or the like provide the danger of malfunction.

Thus, having provided a vacuum lift system that operates in improved modes eliminating the possibility of operator errors under critical control conditions and providing control of the lifting mechanisms in a noncritical proportional operating mode that requires little operator expertise, those novel features defining the spirit and nature of the invention are set forth with particularity in the following claims.

I claim:

1. In a vacuum powered lifting system, comprising, a vacuum source, a variable length longitudinal body, means for coupling said body to said vacuum source for selectively foreshortening the body in length in response to reduced air pressure in the body established by said source, lifting means adapted to grasp a work load object with the body to move the object vertically as a function of the foreshortening in length of the body, improved body length adjustment means for introducing variable quantities of air flow into the body to modify pressure established by said vacuum source, comprising in combination, a mechanism providing a substantially proportional movement of a control member for controlling of length of the body over a control range having uppermost vertical object position limits, and a single air control valve operable by said control member over said range for introducing a flow of air at atmospheric pressure into the body of a magnitude produced in proportion to the magnitude of movement of said control member for producing a corresponding change in the length of said body under load conditions, wherein said air control valve comprises air injection means introduced into said body at an exit port slot for releasing atmospheric air within the longitudinal body and control member actuated movable diaphragm means for opening a controlled length of the slot for releasing air.

2. The adjustment means of claim 1 further comprising, adjustable biasing means for establishing a predetermined normal position of said control member when not variably controlled manually by an operator thereby comprising variably adjustable height control means for establishing a predetermined pressure within the body at said normal position to establish a pre-set maximum lift height limit.

3. The adjustment means of claim 2 wherein said height control means further comprises, variably adjustable means, namely a variably adjustable valve for introducing a magnitude of flow of air into the body for establishing the height limit when there is no work load object being lifted by the body.

4. The adjustment means of claim 2 wherein said height control means further comprises, variably adjustable means for setting a minimal quantity of flow of air through said air control valve when a work load object is being lifted by the body.

5. The adjustment means of claim 4 wherein the height limit control means further comprises counter biasing means coupled for exerting a greater force on said control member than said biasing means position for establishing said normal position, thereby to position said control member in a position providing said minimal quantity of flow of air.

6. The adjustment means of claim 1 wherein said body further comprises an object grasping surface for grasping the object by means of a pressure differential inside and outside said body, having a normally open variably adjustable air flow input port on the grasping surface for continuously introducing a controllable flow of air into the body when a work object is not grasped for establishing a no-load height limit.

7. In a vacuum powered lifting system, comprising, a vacuum source, a variable length longitudinal body, means for coupling said body to said vacuum source for selectively foreshortening the body in length in response to reduced air pressure in the body established by said source, lifting means adapted to grasp a workload object with the body to move the object vertically as a function of the foreshortening in length of the body, improved body length adjustment means for introducing variable quantities of air flow into the body to modify pressure established by said vacuum source, comprising in combination, a mechanism providing a substantially proportional movement of a control member for controlling of the length of the body over a control range having uppermost vertical object position limits, and a single air control valve operable by said control member over said range for introducing a flow of air at atmospheric pressure into the body of a magnitude produced in proportion into the magnitude of movement of said control member for producing a corresponding change in the length of said body under load conditions, wherein said air control valve further comprises a substantially linear longitudinal housing disposed within said body having an axially positioned member movable along an axially disposed slot to variably control the quantity of air flow path extending through a portion of the slot.

8. A vacuum powered lifting system comprising in combination, a vacuum source, a variable length lifting mechanism housing coupled to the vacuum source to vary in length as a function of differential pressure from atmospheric within the housing, means for coupling the lifting mechanism to a work load object for lifting and transport by means of reduced pressure from the vacuum source, differential pressure control means for introducing atmospheric air into said housing to control the length of the lifting mechanism, a manually moveable control member operable to control the magnitude of flow of said atmospheric air into said housing for manipulating loads, a single air dispensing valve controlled by movement of said control member to produce said atmospheric air flow magnitude into said housing with movement of the control member that progressively changes the mechanism housing length over a predetermined control range and vacuum operated grasping means for securing a work load to the lifting mechanism under control of pressure differential within said housing comprising a port in said housing and adjustable valve means for said port for maintaining a continuous predetermined magnitude of flow of air into said port when a work load is not in grasp.

* * * * *